US005124894A

United States Patent [19]

Shiau

[11] Patent Number: 5,124,894

[45] Date of Patent: Jun. 23, 1992

[54] VARIABLE FOCUSING FLASHLIGHT

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 797,131

[22] Filed: Nov. 22, 1991

[51] Int. Cl.[5] ..... F21L 15/02

[52] U.S. Cl. ..... 362/187; 362/205

[58] Field of Search ..... 362/187, 188, 202, 205, 362/277, 318, 208

[56] References Cited

U.S. PATENT DOCUMENTS

| | | | |
|---|---|---|---|
| 4,472,766 | 9/1984 | Hung | 362/205 |
| 4,916,588 | 4/1990 | Chu | 362/187 |
| 4,942,505 | 7/1990 | Maglica | 362/187 |
| 5,021,934 | 6/1991 | Hou | 362/187 |

*Primary Examiner*—Richard R. Cole
*Attorney, Agent, or Firm*—Darby & Darby

[57] ABSTRACT

A variable focusing flashlight includes a metal barrel and an insulating support fixed in the barrel by a metal pin. A first clamping member includes a first tubular portion fixed in an inner peripheral flange of the insulating support, and a first radial flange resting on the inner peripheral flange. A bulb has a radial conductive flange resting on the first radial flange and a bottom conductive bead connected to a cell in the barrel. A second clamping member includes a second tubular portion detachably sleeved over the first clamping member and a second radial flange clamping the radial conductive flange against the first radial flange. A compression spring is sleeved around the inner peripheral flange and electrically contacts the pin and the second clamping member. A second insulating tubular member is slidably sleeved around the second clamping member and rests on the compression spring. A head adapted to threadedly engage the metal barrel has a concave reflector mounted in the head to contact the second insulating tubular member.

3 Claims, 4 Drawing Sheets

VARIABLE FOCUSING FLASHLIGHT

BACKGROUND OF THE INVENTION

1. Field of the Invention

This invention relates to a flashlight, more particularly to an improved variable focusing flashlight.

2. Description of the Related Art

Referring to FIGS. 1 and 2, a conventional variable focusing flashlight includes a metal barrel (11) for receiving a cell unit (11') therein. The metal barrel (11) has an open end formed with an inwardly annular conductive flange (111), and a covering (14) formed with a metal compression spring (141) in contact with the cell unit (11'). A bulb support (12') includes a first insulating member (12) provided in the metal barrel (11) adjacent to the open end thereof. The first insulating member (12) includes a first base plate having a pair of opposite curved slots (123) and an annular peripheral flange extending from the first base plate. The bulb support (12') further includes a second insulating member (13). The second insulating member (13) includes a second base plate (131) and a pair of opposite curved plates (132) extending from the second base plate (131). The second base plate (131) is adapted to rest against the annular conductive flange (111). The curved plates (132) are inserted into the metal barrel (11) and fixedly engaged in the curved slots (123). A bulb (16) is mounted on the second base plate (131) and has two conductive plugs passing through the second base plates (131). The first insulating member (12) further includes an L-shaped first conductive member (121) mounted thereon and connected to one of the conductive plugs of the bulb (16), and a second conductive member (122) mounted thereon and connected to the other of the conductive plugs of the bulb (16) and to the cell unit (11'). A flashlight head (15) includes a tubular portion having an end formed with an engaging opening adapted to threadedly engage the metal barrel (11), and a concave reflector (151) fixed in the tubular portion having an enlarged open end and a constricted open end in contact with the second base plate (131). The bulb (16) is deactivated when the flashlight head (15) is rotated toward the metal barrel (11) so that the concave reflector (151) urges the second base plate (131) to rest against the annular conductive flange (111), thereby breaking electrical contact between the first conductive member (121) and the annular conductive flange (111). The bulb (16) is activated when the flashlight head (15) is rotated away from the metal barrel (11) so that the first conductive member (121) electrically contacts the annular conductive flange (111) by the metal compression spring (141) biasing the first insulating member (12) toward the annular conductive flange (111). The flashlight head (15) is rotated relative to the metal barrel (11) so as to vary the distance between the bulb (16) and the enlarged open end of the concave reflector (151) in order to adjust the focal distance of the light output of the bulb (16). The bulb support (12') is moved relative to the metal barrel (11) to activate and deactivate the bulb (16). The bulb support (12') easily sways and is positioned in an unstable manner, thereby affecting the conduction effect of the bulb (16).

SUMMARY OF THE INVENTION

Therefore, the objective of this invention is to provide an improved variable focusing flashlight having a better and more stable conduction effect.

Accordingly, a variable focusing flashlight of this invention includes a metal barrel having a cell unit received therein and a top open end. An insulating support is fixed in the metal barrel adjacent to the top open end thereof. The insulating support includes a base plate transversely provided in the metal barrel. The base plate has an external boundary, a central opening, an inner peripheral flange extending upwardly from the base plate at the central opening, and an outer peripheral flange extending upwardly from the external boundary and contacting the metal barrel.

A metal pin extends from the metal barrel through the outer peripheral flange to fix the insulating support in the metal barrel near the top open end of the metal barrel.

A first clamping member includes a first tubular portion having a first top open end, a first bottom open end, and a first radial flange extending outwardly from the first top open end. The first tubular portion is inserted into and fixed to the inner peripheral flange of the insulating support. The first radial flange rests on the inner peripheral flange of the insulating support.

A first insulating tubular member is fixed in the first tubular portion of the first clamping member and extends into the central opening of the insulating support.

A flashlight bulb includes an upper bulb portion, a lower elongated body formed with a bottom conductive bead, and an intermediate radial conductive flange. The radial conductive flange rests on the first radial flange of the first clamping member. The lower elongated body extends into the first tubular portion of the first clamping member and contacts the first insulating tubular member. The flashlight bulb further includes a conductor to electrically interconnect the bottom conductive bead and the cell unit.

A second clamping member made of metal includes a second tubular portion having a second top open end, a second bottom open end, and a second radial flange extending inwardly from the second top open end. The second clamping member is sleeved over and detachably engaged with the first clamping member. The second radial flange clamps the radial conductive flange of the flashlight bulb against the first radial flange of the first clamping member. The bulb portion extends out of the second top open end.

A conductive compression spring is sleeved around the inner peripheral flange and electrically contacts the metal pin at one end thereof and is detachably connected to the second clamping member at the other end thereof.

A second insulating tubular member is slidably sleeved around the second clamping member. The second insulating tubular member has a third top open end and a third bottom open end resting on the conductive compression spring.

A flashlight head includes a third tubular portion having a bottom engaging opening adapted to threadedly engage the metal barrel, and a concave reflector fixed in the third tubular portion. The concave reflector has an enlarged top open end and a constricted bottom open end in contact with the third top open end of the second insulating tubular member. The flashlight head is rotated relative to the metal barrel so as to vary the distance between the bulb portion and the enlarged top open end of the concave reflector in order to adjust the focal distance of the light output of the bulb portion. The flashlight bulb is activated when the conductive compression spring electrically contacts the second clamping member. The flashlight bulb is deactivated when the flashlight head is rotated relative to the metal barrel so that the concave reflector urges the second insulating tubular member to compress the other end of the conductive compression spring thereby separating the second clamping member therefrom.

BRIEF DESCRIPTION OF THE DRAWING

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
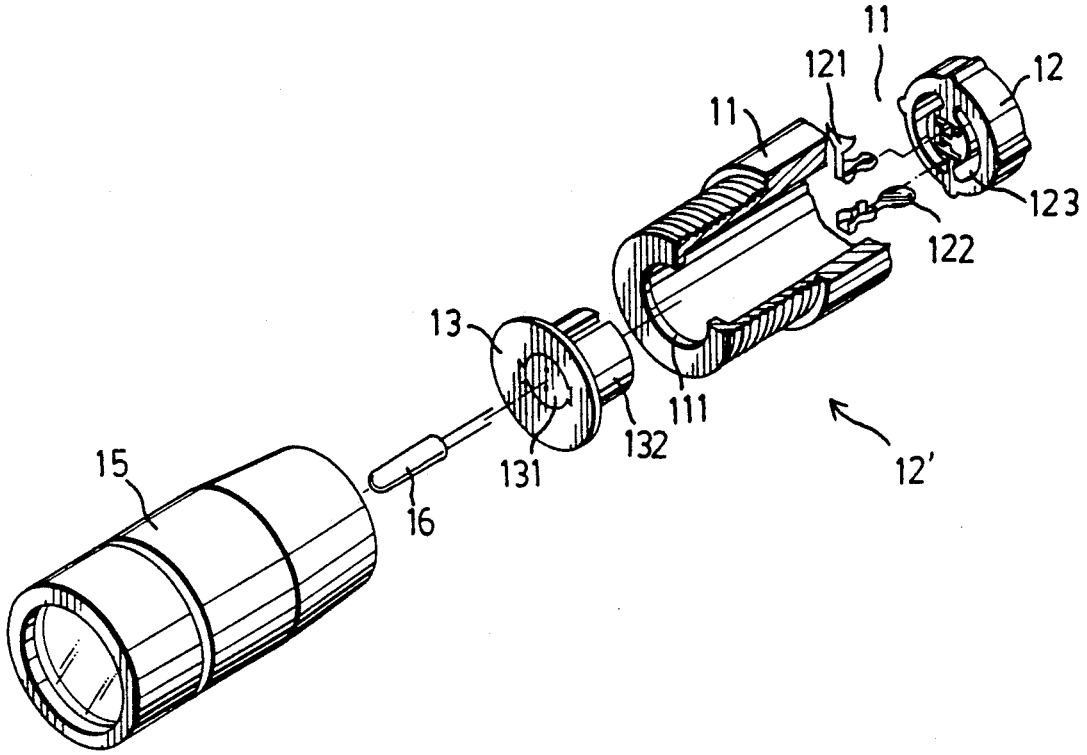
FIG.1 (PRIOR ART)
FIG. 1 is a partial exploded view of a conventional variable focusing flashlight.
Figure 2:
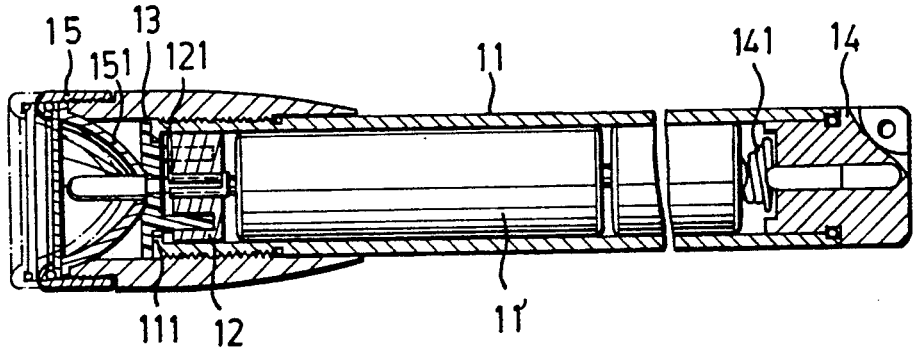
FIG.2 (PRIOR ART)
FIG. 2 is a sectional view of the conventional variable focusing flashlight.
Figure 3:
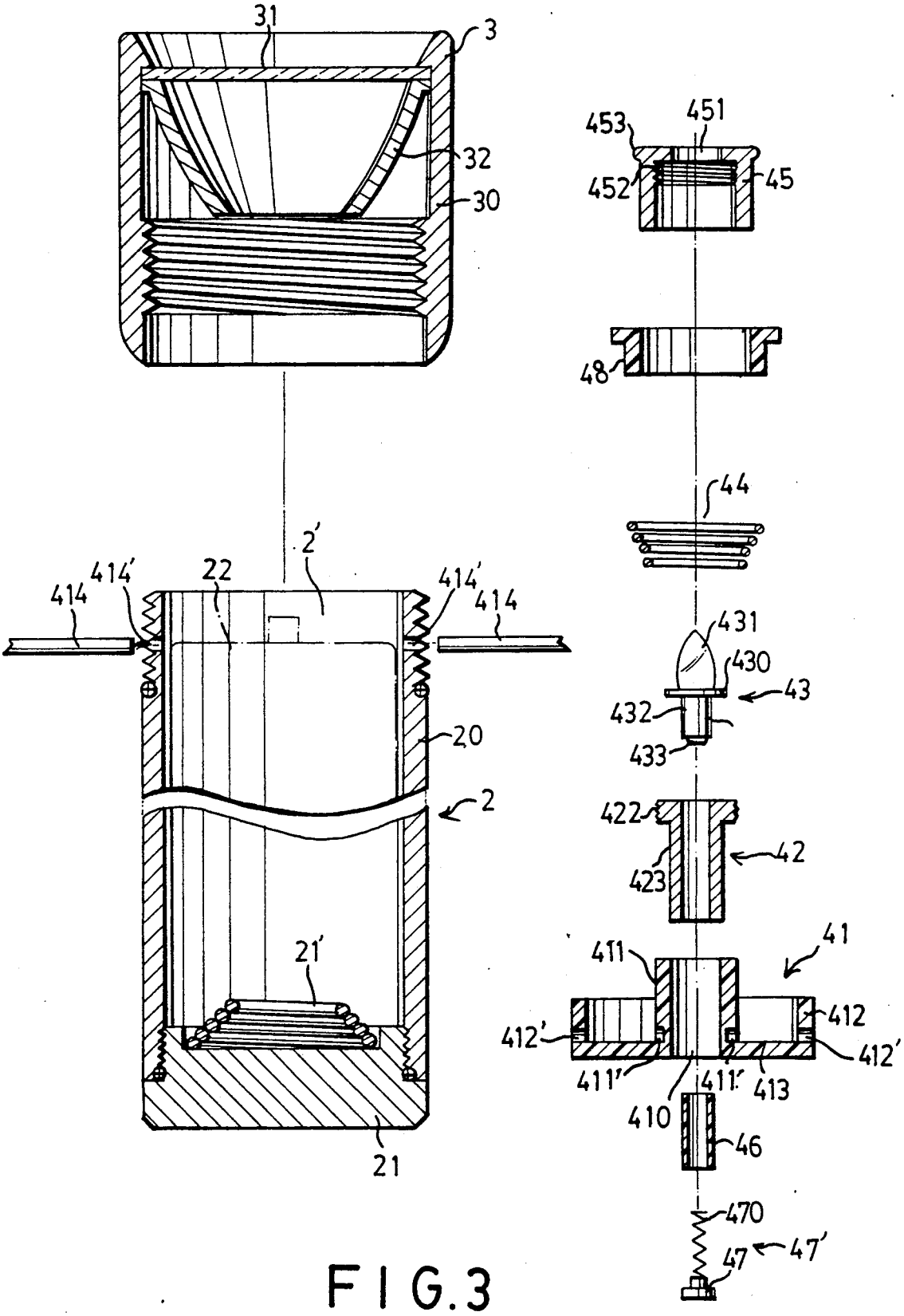
FIG. 3 is an exploded view of a variable focusing flashlight of this invention.
Figure 4:
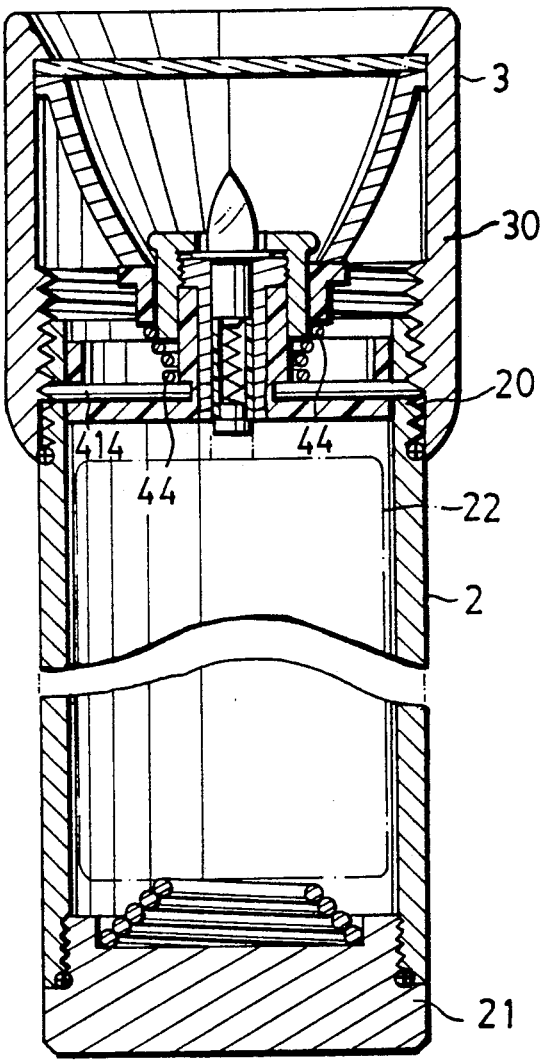
FIG. 4 is a sectional view of the variable focusing flashlight of this invention showing the flashlight bulb when activated.

Referring to FIGS. 3 and 4, a variable focusing flashlight of this invention includes a metal barrel (2) for receiving a cell unit (22) therein. The metal barrel (2) includes a tubular portion (20) having a top open end (2') and a bottom metal covering (21) formed with a metal compression spring (21'). The tubular portion (20) of the metal barrel (2) has two aligned through holes (414') and external threads adjacent to the top open end (2'). An insulating support (41) includes a base plate (413). The base plate (413) has an external boundary, a central opening (410), an inner peripheral flange (411) extending upwardly from the base plate (413) at the central opening (410), and an outer peripheral flange (412) extending upwardly from the external boundary. The outer peripheral flange (412) has two aligned through holes (412'). The inner peripheral flange (411) has two aligned bores (411'). The insulating support (41) is fixed in the metal barrel (2) near the top open end (2') by a pair of metal pins (414) respectively passing through the through holes (414') of the metal barrel (2) and the through holes (412') of the outer peripheral flange (412) and being received in the bores (411') of the inner peripheral flange (411). The outer peripheral flange (412) contacts the inner surface of the metal barrel (2).

A first clamping member (42) made of a metal material includes a first tubular portion (423) having a first top open end, a first bottom open end and a first radial flange (422) extending outwardly from the first top open end. The first tubular portion (423) is inserted into and frictionally engaged with the inner peripheral flange (411). The first radial flange (422) rests on the inner peripheral flange (411).

A first insulating tubular member (46) is inserted into and frictionally engaged in the first tubular portion (423).

a flashlight bulb (43) includes an upper bulb portion (431), a lower elongated body (432) formed with a bottom conductive bead (433), and an intermediate radial conductive flange (430) made of a metal material. The radial conductive flange (430) rests on the first radial flange (422). The elongated body (432) extends into the first tubular portion (423) and contacts the first insulating tubular member (46). The flashlight bulb (43) further includes a conductor (47'). The conductor (47') has a metal spring (470) electrically connected to the bottom conductive bead (433), and a conductive piece (47) which is frictionally engaged in the first insulating tubular member (46) and electrically connected to the metal spring (470) and to the cell unit (22).

A second clamping member (45) made of a metal material includes a second tubular portion (452) having a second top open end (451), a second bottom open end, and a second radial flange (453) extending inwardly and outwardly from the second top open end (451). The second clamping member (45) is sleeved over and threadedly engaged with the first clamping member (42). The second radial flange (453) clamps the radial conductive flange (430) against the first radial flange (422). The bulb portion (431) extends out of the second top open end (451).

A conductive compression spring (44) made of a metal material is sleeved around the inner peripheral flange (411) above the metal pins (414). The conductive compression spring (44) is a gradually expanding coil spring. The conductive compression spring (44) electrically contacts the metal pins (414) at one end thereof and is detachably connected to the second bottom open end of the second clamping member (45) at the other end thereof.

A second insulating tubular member (48) is slidably sleeved around the second tubular portion (452) of the second clamping member (45). The second insulating tubular member (48) has a third top open end formed with an outwardly extending radial flange, and a third bottom open end resting on the conductive compression spring (44).

A flashlight head (3) includes a third tubular portion (30) having a top end formed with a lens (31), and a bottom open end formed with internal threads and adapted to threadedly engage the metal barrel (2). The flashlight head (3) has a concave reflector (32) fixed in the third tubular portion (30). The concave reflector (32) has an enlarged top open end and a constricted bottom open end in contact with the third top open end of the second insulating tubular member (48).

Figure 5:
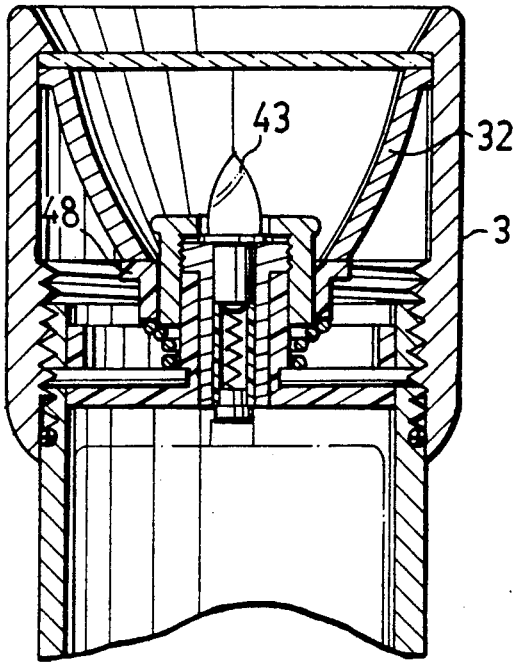
FIG. 5 is a sectional view of the variable focusing flashlight of this invention showing the rotating of the flashlight head relative to the metal barrel in order to adjust the focal distance for the light output of the flashlight bulb.
Figure 6:
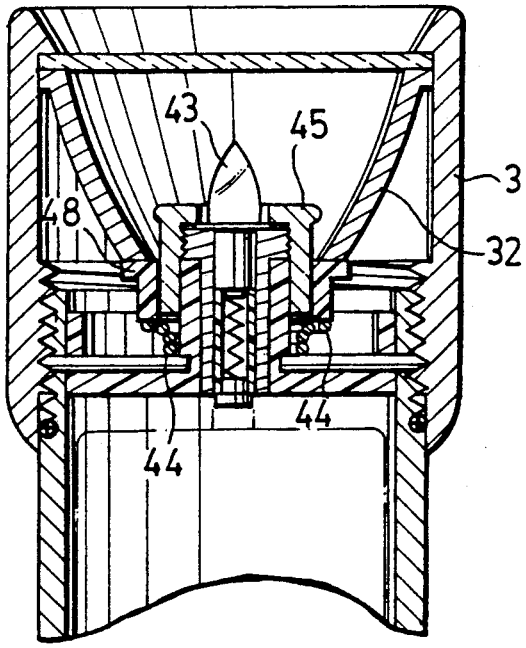
FIG. 6 is a sectional view of the variable focusing flashlight of this invention showing the flashlight bulb when deactivated.

The radial conductive flange (430) of the flashlight bulb (43), the second clamping member (45), the conductive compression spring (44), the tubular portion (20) of the metal barrel (2), the covering (21), the compression spring (21'), the cell unit (22), the conductor (47'), and the conductive bead (433) of the flashlight bulb (43) cooperatively constitute a closed electrical loop. Referring again to FIG. 4, the flashlight bulb (43) is activated when the conductive compression spring (44) electrically contacts the second clamping member (45). Referring to FIG. 5, the flashlight head (3) is rotated relative to the metal barrel (2) so as to vary the distance between the bulb portion (431) and the enlarged top open end of the concave reflector (32) in order to adjust the focal distance of the light output of the bulb portion (431). Referring to FIG. 6, the flashlight bulb (43) is deactivated when the flashlight head is rotated toward the metal barrel (2) so that the concave reflector (32) urges the second insulating tubular member (48) to compress the other end of the conductive compression spring (44) thereby separating the second clamping member (45) therefrom.

The insulating support (41) is fixed in the metal barrel (2). The flashlight bulb (43) is fixed to the insulating support (41) via the first and second clamping member (42, 45). Therefore, the flashlight bulb (43) has a better and more stable conduction effect by means of the conductive compression spring (44) as compared with that of the conventional variable focusing flashlight. The variable focusing flashlight of this invention further has a waterproof washer provided on the external threads of the tubular portion (20) of the metal barrel (2).

While the present invention has been described in connection with what is considered the most practical and preferred embodiment, it is understood that this invention is not limited to the disclosed embodiments, but is intended to cover various arrangements included within the spirit and scope of the broadest interpretations and equivalent arrangements.

I claim:

1. A variable focusing flashlight comprising:

a metal barrel having a cell unit received therein and a top open end;

an insulating support fixed in said metal barrel adjacent to said top open end thereof, said insulating support including a base plate transversely provided in said metal barrel, said base plate having an external boundary, a central opening, an inner peripheral flange extending upwardly from said base plate at said central opening, and an outer peripheral flange extending upwardly from said external boundary and contacting said metal barrel;

a metal pin extending from said metal barrel through said outer peripheral flange to fix said insulating support in said metal barrel near said top open end of said metal barrel;

a first clamping member including a tubular portion having a top open end, a bottom open end, and a radial flange extending outwardly from said first clamping member top open end, said first clamping member tubular portion being inserted into and fixed to said inner peripheral flange of said insulating support, said first clamping member radial flange resting on said inner peripheral flange of said insulating support;

a first insulating tubular member fixed in said tubular portion of said first clamping member and extending into said central opening of said insulating support;

a flashlight bulb including an upper bulb portion, a lower elongated body formed with a bottom conductive bead, and an intermediate radial conductive flange, said radial conductive flange resting on said radial flange of said first clamping member, said lower elongated body extending into said tubular portion of said first clamping member and contacting said first insulating tubular member, said flashlight bulb further including a conductor to electrically interconnect said bottom conductive bead and said cell unit;

a second clamping member made of metal including a tubular portion having a top open end, a bottom open end, and a radial flange extending inwardly from said second clamping member top open end, said second clamping member being sleeved over and detachably engaged with said first clamping member, said second clamping member radial flange clamping said radial conductive flange of said flashlight bulb against said radial flange of said first clamping member, said bulb portion extending out of said second clamping member top open end;

a conductive compression spring sleeved around said inner peripheral flange, said conductive compression spring being electrically connected to said metal pin at one end thereof and detachably connected to said second clamping member at a second end thereof;

a second insulating tubular member slidably sleeved around said second clamping member, said second insulating tubular member having a top open end and a bottom open end resting on said conductive compression spring;

a flashlight head including a tubular portion having a bottom engaging opening adapted to threadedly engage said metal barrel, and a concave reflector fixed in said flashlight head tubular portion, said concave reflector having an enlarged top open end and a constricted bottom open end in contact with said top open end of said second insulating tubular member, said flashlight head being rotated relative to said metal barrel so as to vary a distance between said bulb portion and said enlarged top open end of said concave reflector in order to adjust a focal distance for light output of the bulb portion, said flashlight bulb being activated when said conductive compression spring electrically contacts said second clamping member, said flashlight bulb being deactivated when said flashlight head is rotated relative to said metal barrel so that said concave reflector urges said second insulating tubular member to compress the second end of said conductive compression spring thereby separating said second clamping member therefrom.

2. A variable focusing flashlight as claimed in claim 1, wherein said conductor of said flashlight bulb includes a metal spring connected to said bottom conductive bead and a conductive piece connected to said metal spring and said cell unit.

3. A variable focusing flashlight as claimed in claim 1, wherein said second clamping member has a portion extending radially and outwardly from said second clamping member tubular portion thereof to prevent said second insulating tubular member from upwardly sliding out of said second clamping member.

* * * * *